United States Patent [19]

Baranyi

[11] Patent Number: 4,685,815

[45] Date of Patent: Aug. 11, 1987

[54] PRINTING APPARATUS

[75] Inventor: Sandor J. Baranyi, Riverton, Wyo.

[73] Assignee: Eaton Corporation, Cleveland, Ohio

[21] Appl. No.: 842,445

[22] Filed: Mar. 21, 1986

[51] Int. Cl.[4] ..... B41J 3/02; B41J 13/10

[52] U.S. Cl. ..... 400/120; 400/125.1; 400/54; 400/55; 400/644; 271/900

[58] Field of Search ..... 400/54–56, 400/120, 124, 125.1, 613–614, 633, 644; 271/900, 307, 308, 311, 312

[56] References Cited

U.S. PATENT DOCUMENTS

| | | | |
|---|---|---|---|
| 3,918,702 | 11/1975 | Mihalik | 271/900 |
| 3,948,507 | 4/1976 | Stange | 271/900 |
| 4,169,682 | 10/1979 | Norman | 400/55 |
| 4,235,555 | 11/1980 | Aprato | 400/120 |
| 4,244,648 | 1/1981 | Schultes et al. | 271/308 |
| 4,364,657 | 12/1982 | Landa | 271/900 |
| 4,514,100 | 4/1985 | Laspesa | 400/55 |
| 4,525,084 | 6/1985 | Ikeda | 400/55 |
| 4,560,292 | 12/1985 | Takahashi | 400/120 |

FOREIGN PATENT DOCUMENTS

| | | | |
|---|---|---|---|
| 2651724 | 5/1977 | Fed. Rep. of Germany | 271/312 |
| 2712804 | 9/1977 | Fed. Rep. of Germany | 271/311 |
| 51378 | 5/1981 | Japan | 400/613 |
| 69078 | 4/1982 | Japan | 400/644 |
| 148676 | 9/1982 | Japan | 400/613 |
| 214680 | 12/1984 | Japan | 400/55 |

OTHER PUBLICATIONS

"Web Media Roll Take-Up Clamp" IBM Tech. Discl. Bulletin, vol. 20, No. 10, Mar. 1978, pp. 4041–4042.

"Roll Paper Attachment and Tear Bar for Wire Matrix Printer" IBM Tech. Discl. Bulletin, vol. 22, No. 10, Mar. 1980, p. 4360.

*Primary Examiner*—E. H. Eickholt

*Attorney, Agent, or Firm*—D. A. Rowe; M. L. Union

[57] ABSTRACT

A printing apparatus including a feed path for print medium to be imprinted. A printing station defined by a printhead that is biased towards abutting contact with a platen roller. A floating mount pivotally mounts the printhead with respect to the platen roller so that a uniform contact pressure is established between the printhead and print medium during printing. The printhead is also mounted for pivotal movement about an axis transverse to the first axis which allows the printhead to move towards and away from the platen roller to facilitate loading of the print medium. A printhead sensor monitors the position of the head and automatically deactivates the printhead when it is about to be, or is separated, from the platen roller. A stripper mechanism is provided for automatically stripping a backing from the print medium and includes a stripper assist bar that causes the backing to follow, and frictionally engage, a peripheral region on the platen roller that is at least 90°. This frictional engagement provides the force needed to pull backing from a label, eliminating the need for separate gripper rollers. A detented adjustable guide is also provided to facilitate changing sizes of the print medium.

13 Claims, 6 Drawing Figures

PRINTING APPARATUS

DESCRIPTION

1. Technical Field

The present invention relates generally to printing and in particular to a printing apparatus for printing indicia on a continuous print medium such as paper tape or continuous labels.

2. Background Art

Printing machines including thermal and electrostatic type printers are used in many applications to imprint a continuous print medium such as paper tape or continuous labels. These applications include cash registers and bar code printers.

In a bar code printer, the print medium typically includes adhesive labels carried on a continuous backing or carrier. The label is conveyed through a print station and receives an image as it passes a printhead. The process for creating image may be a direct mechanical process utilizing a matrix printhead having an array of reciprocal pins that are driven towards the paper. An ink ribbon is disposed between the pins and the print medium and transfers ink to the print medium when struck by the pins.

Another type of printing process is known as thermal printing and utilizes a printhead having a plurality of heating elements that can be selectively energized. Selective heating of the elements forms an image on the print medium as it passes the printhead.

Two types of thermal printing processes are known: (a) direct and (b) transfer. In a direct thermal printer, a chemically treated print medium directly reacts to heat generated by the printhead and forms the image as it passes the printhead. In a thermal transfer printer a thermal reactive ribbon forms the image on the print medium which may be untreated or plain paper.

In both types of printers, close intimate contact between the printhead and the print medium must be established if an acceptable image is to be generated. This becomes especially critical, when the print mechanism is used to print bar codes on package labels. Since the bar codes must be readable by a bar code reader, it is important that the image be of good quality and uniform. To assure uniform image density in a thermal printer, it is imperative that uniform pressure between a platen and the printhead be established. In normal operation, the platen comprises a roller and conveys the print medium past the printhead and applies a clamping pressure to urge the print medium into contact with the printhead. If the contact is non-uniform, image degradation results.

In many of these types of printing applications, it is desireable to strip the label from its backing immediately after printing. Mechanisms for achieving this feature have been suggested. In one suggested device, a path for the backing is established which diverges from the label path so that as the label leaves the print station, it separates from its backing. The backing is usually wound on to the takeup reel. Since a substantial force is needed to separate the label from its backing, the backing is normally passed through gripper or capstan rollers which grip and drive the backing onto the takeup reel.

To facilitate printer operation, it is desireable that access to the print medium path be provided so that the print supply, i.e., labels or paper tape, can be easily removed and/or reloaded. It is also desireable for the printing device to accommodate a variety of print medium widths. Changeovers to a different medium width should be achievable without substantial disassembly or readjustment.

DISCLOSURE OF INVENTION

The present invention provides a new and improved printing apparatus in which contact pressure between the print medium and printhead is substantially uniform. The uniform pressure is achieved and maintained without requiring precise and time consuming adjustments. The present invention also provides a method and apparatus for automatically stripping a backing or carrier from labels after printing. This is accomplished with a simple and reliable mechanism that does not require separate gripper or capstan rollers to drive the backing onto a takeup reel.

In the preferred and illustrated embodiment, the printing apparatus defines a path through which the print medium is conveyed. The path includes a print station defined by a printhead and a platen between which the print medium is conveyed. In the preferred embodiment, the platen comprises a driven roller. During a printing operation, the printhead is biased towards the platen roller so that, as the print medium passes between the roller and the printhead, the print medium is urged into close contact with the printhead. In accordance with the invention, the printhead is allowed to float with respect to the platen roller so that the contact pressure between the printhead and the print medium equalizes. The floating relationship allows the printhead to accommodate or compensate for misalignment between the platen roller and the printhead as well as thickness variations in the print medium.

In the preferred embodiment, the floating relationship is provided by pivotally mounting the printhead with respect to the platen roller. The axis of the pivot is substantially transverse to the rotational axis of the platen roller but, in the preferred embodiment, the pivot axis does not intersect the rotational axis of the roller. In the preferred arrangement, the pivot is located substantially centrally with respect to the transverse dimension of the printhead.

According to a feature of this embodiment, the printhead is movable towards and away from the platen roller about a transverse axis that is substantially parallel to the axis of the platen roller. This second pivot axis of the printhead enables the printhead to be separated from the platen roller when the printing device is being loaded with the print medium. In the preferred embodiment, a resilient element, such as a spring is used to bias the printhead towards contact with the platen roller. A cam arrangement forming part of the print apparatus is operable to oppose the spring force and rotate the printhead about the second axis to cause movement of the printhead away from the roller.

According to another feature of this embodiment, the printhead position with respect to the platen roller is monitored by a sensor. When the printhead is about to be or is separated from the platen roller, the sensor disables the printhead to prevent its energization. This feature prevents damage to the printhead which may occur if energized when not in contact with the platen roller or the print medium. In the case of thermal printers, the thermal print element may be damaged due to the inability to dissipate the energy generated during printhead operation when the printhead is not in contact with the print medium.

In accordance with this feature, a slight delay or dwell is established between the deactivation of the printhead and its actual movement away from the platen roller. With the preferred arrangement, the printhead is deactivated prior to separation from the platen roller. In the illustrated embodiment, this feature is provided by a second cam which is driven concurrently with the cam used to separate the printhead from the platen. The second cam activates a printhead disabling element such as an on/off switch. In order to insure deactivation of the printhead before separation of the printhead from the platen roller, the cam driving the switch is advanced so that the switch is actuated prior to actuation of the head separating mechanism by the first cam.

According to another embodiment of the invention, the printhead includes a simple but effective stripping mechanism for automatically separating pressure sensitive or adhesive labels from their backing or carrier after being printed. In the preferred and illustrated construction, the label and carrier are conveyed between the platen roller and printhead. A stripper plate is positioned immediately downstream of the print station and is preferably located parallel to and immediately adjacent, the platen roller. In normal operation, as the label leaves the printing station, it tends to travel along a feed path located in a plane substantially tangent to a printing line defined between the printhead and the platen roller. When stripping of the backing is desired, the backing is directed along a path that diverges substantially from the feed path of the label. In the preferred arrangement, the backing is conveyed over the stripper plate and then directed rearwardly so that it follows the contour and contacts a portion of the periphery of the platen roller. In effect, the backing is "wrapped" around a substantial portion of the platen.

In order to achieve this feature, the backing is caused to travel around the platen roller by a stripper assist bar which is defined by a post or shaft disposed immediately adjacent the platen roller, but spaced therefrom, and having an axis substantially parallel to the axis of the platen roller. In the preferred arrangement, the stripper assist bar is located such that the backing is wrapped around at least 90° of the platen roller periphery. In the illustrated embodiment the stripper assist bar is located in the range of 180°–270° from the print line as measured in the direction of rotation of the platen roller.

With the disclosed arrangement, the backing is in frictional engagement with a substantial portion of the platen roller. The platen roller is normally driven in order to feed the label and carrier past the printhead. The frictional engagement between the backing and the platen roller is used to drive the backing and hence facilitates separation of the label from the backing. With the illustrated construction, separate gripper drive rollers or a capstan drive are obviated. The platen roller itself in cooperation with the stripper assist bar provides the necessary tension that is needed to pull the backing onto the takeup reel after separation from the label.

In accordance with a feature of the invention, the stripper assist bar forms part of an assembly that is pivotally mounted for movement between an operative and a retracted position. When separation of the label and backing is not desired, the stripper assist bar may be retracted and the backing or carrier strip is allowed to proceed along the label feed plane and thus remain with the label for separation at a later time.

According to still another feature of the invention, an adjustable detented guide is located immediately upstream from the platen roller. In the preferred construction, the guide comprises a shaft slidably mounting a collar. The collar is movable to any one of a plurality of detented positions on the shaft in order to accommodate a variety of label or print medium widths. When changing label sizes, the collar is simply moved to the detented position corresponding to the width of the print medium being loaded into the printing mechanism.

The disclosed printing apparatus, although simple in construction, is capable of high quality images which are necessary in bar code applications. In addition, a simplified stripping mechanism is provided which eliminates the need for separate drive elements to effect stripping of the backing from the labels.

Additional features of the invention will become apparent and a fuller understanding obtained by reading the following detailed description made in connection with the accompanying drawings.

BEST MODE FOR CARRYING OUT INVENTION

Figure 1:
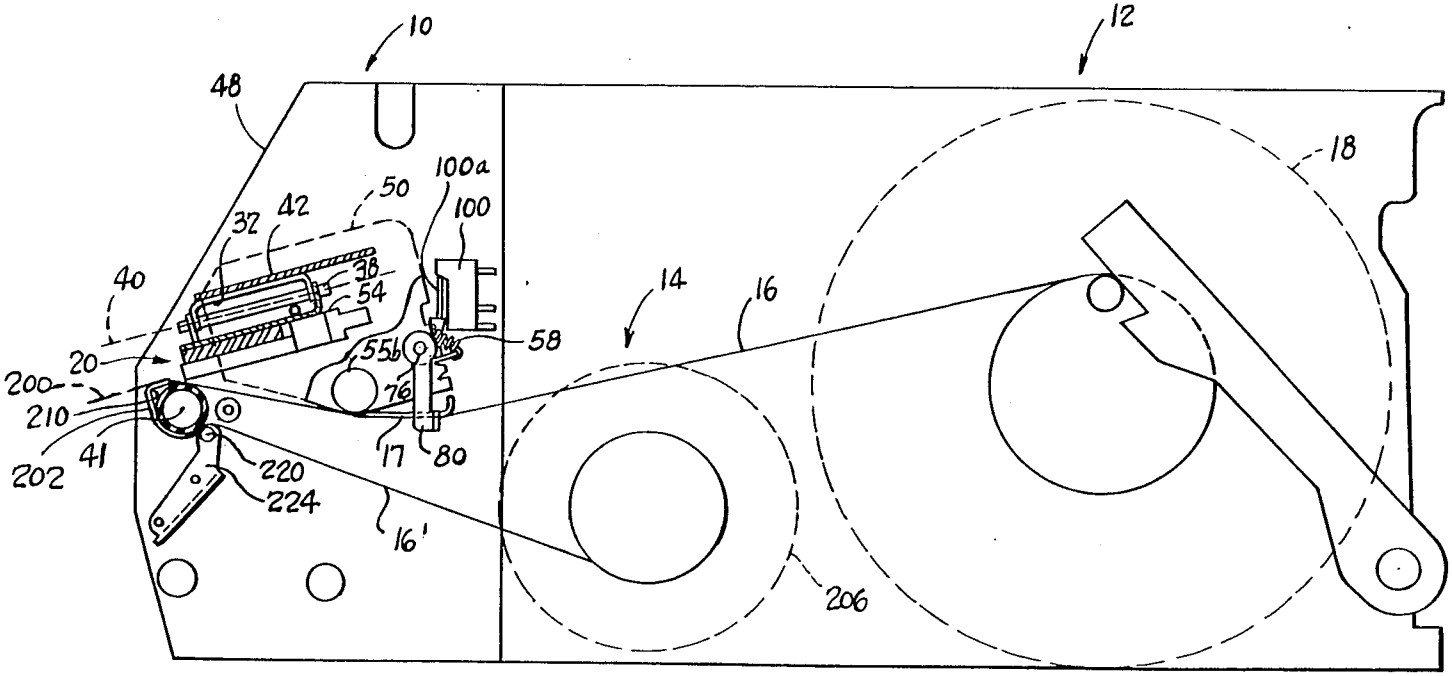
FIG. 1 is a side elevational view, shown somewhat schematically, of the overall construction of a printing apparatus made in accordance with a preferred embodiment of the invention.

FIG. 1 illustrates the overall construction of a printing apparatus constructed in accordance with a preferred embodiment of the invention. The apparatus includes a printing unit or station indicated generally by the reference character 10 and a print medium supply indicated generally by the reference character 12. In the illustrated embodiment, the apparatus also includes a takeup mechanism indicated generally by the reference character 14 which is used when the printing apparatus is printing labels that are to be stripped from a backing material immediately after printing.

The printing mechanism 10 is operative to imprint or image a print medium 16 which is supplied in continuous form and fed from a supply reel or spool 18. The print medium may be a paper tape, continuous pressure sensitive labels or other suitable print material. A tensioning arm 17 is provided to maintain tension in the medium.

The invention will be described in connection with a thermal printing process. It should be understood, however, that at least some of the aspects of the invention are useable with reclaimed matrix printers, electrostatic printers, etc.

Figure 2:
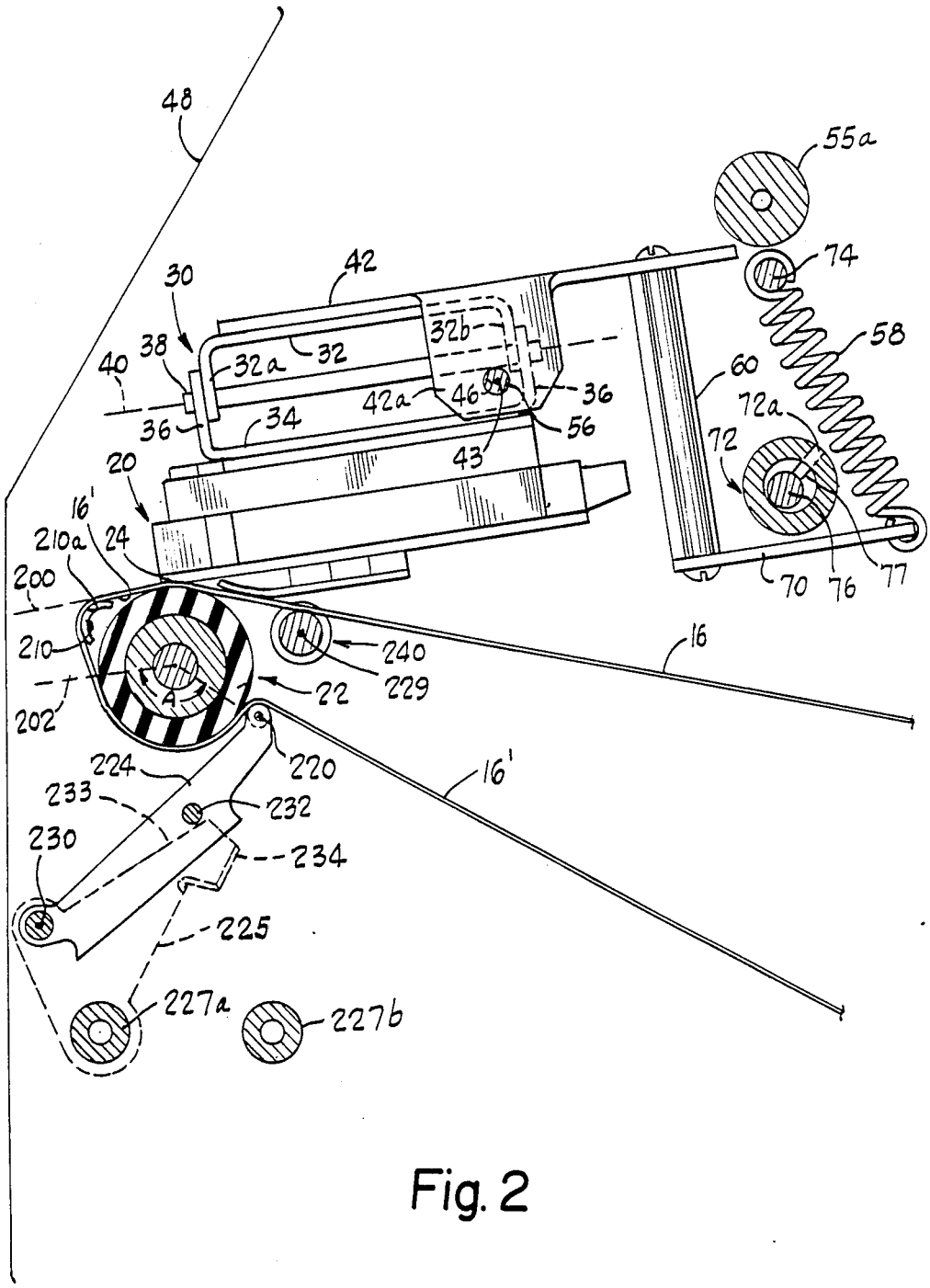
FIG. 2 is an enlarged, fragmentary view, partially in section, of the apparatus shown in FIG. 1.

As seen in FIGS. 1 and 2, the print unit 10 includes a printhead 20 including a portion positioned immediately and in close proximity with a platen roller 22. The print medium is fed from the spool 18 and between the printhead 20 and the platen roller 22. In the preferred embodiment, the platen roller is driven by a motor (not shown) and pulls the print medium 16 through the print unit. A print line 24 is defined between the printhead 20 and the platen roller 22 and is the position where imaging of the print medium occurs.

The printhead 20 is of conventional construction and although it may be of an electrostatic variety, in the illustrated embodiment, it is a thermal printhead and is available from the ROHM Corporation. As is known, regions defined by thermal elements are selectively energized to selectively heat corresponding regions on the print medium as it moves past the printhead 20. The regions on the print medium that are heated darken to produce an image.

The printhead 20 is supported in predetermined alignment with the platen roller by a frame structure indicated generally by the reference character 30. As seen in FIGS. 1 and 2, the printhead 20 is pivotally hung from a U-shaped channel 32 having downwardly depending flanges 32*a*, 32*b* (see also FIGS. 3 and 4). In particular, the printhead includes a support bracket 34 which includes a pair of upstanding, parallel lugs 36 spaced apart on either side of the channel flanges 32*a*, 32*b*. A pivot pin 38 extends through the lugs 36 and the downwardly depending flanges 32*a*, 32*b* of the channel 32. With the disclosed mounting, the printhead 20 "floats" with respect to the platen roller 22. As indicated above, in order to produce high quality images, it is imperative that contact pressure between the printhead 20 and the print medium 16 (along the print line 24) be substantially uniform across the width of the print medium. The pivotal mounting of the printhead 20 enables the printhead 20 to accommodate slight misalignments between the platen roller 22 and the printhead 20 as well as the thickness variations in the print medium so that uniform contact is maintained.

Figure 3:
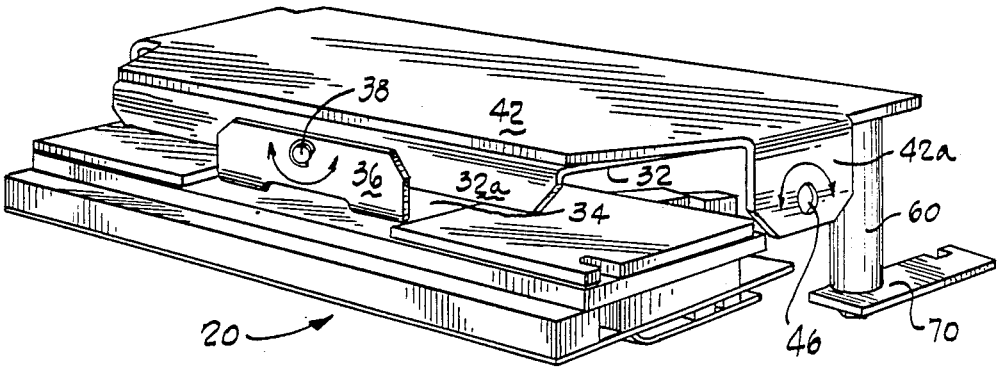
FIG. 3 is a perspective view of a printhead constructed in accordance with a preferred embodiment of the invention.
Figure 4:
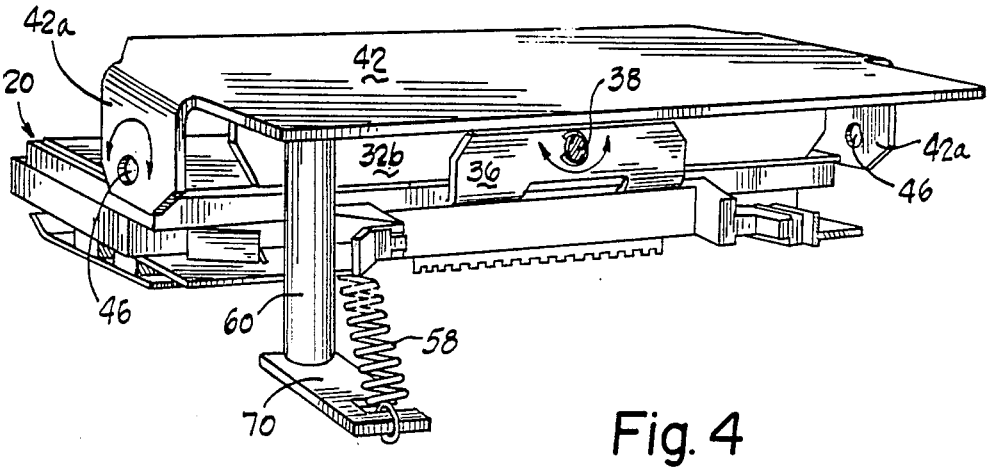
FIG. 4 is another perspective view of the printhead shown in FIG. 3.

As seen in FIG. 3 and 4, the pivot pin 38 is located substantially centrally with respect to a transverse dimension of the print head 20. An axis 40 of the pivot pin 38 is substantially transverse to a rotating axis 41 of the platen roller 22, but in the preferred embodiment, the axes 40, 41 of the pivot 38 and the roller 22 do not intersect.

The printhead 20 is movable towards and away from the platen roller 22 and it is spring biased towards the platen roller. To achieve this feature, the printhead 20 is movable about a second axis 43 which is transverse to the axis 40 of the first pivot. Referring also to FIGS. 2 and 3, the channel 32 is mounted to and depends downwardly from a hinge plate 42. A pair of flanges 42*a* (shown best in FIGS. 3 and 4) depend downwardly from opposite sides of the hinge support plate 42. The flanges defined aligned apertures 46 which defined the transverse pivot axis 43 for the printhead 20. The hinge support plate is mounted between print unit end plates 48, 50 which include aligned apertures. The end plate 50 is shown partially in phantom in FIG. 1 only. The position of the endplate aperture aligned with the associated aperture 46 in the flange 42*a* is indicated by the reference character 54 in FIG. 1 only. The aperture in the endplate 48 is not shown.

The hinge support plate is pivotally supported between the end plates 48, 50 by a shaft 56 which extends through the apertures 46, 54. The shaft 56 is easily removed from the print apparatus to release and dismount the hinge support plate 42 from the print mechanism enabling the printhead 20 to be easily removed and serviced.

The printhead 20 is resiliently biased towards contact with the platen roller 22 by a tension spring 58 which acts between the hinge plate 42 and the print mechanism frame. In particular, a downwardly extending post 60 is fastened to the underside of the hinge plate 42. An arm 70 extends rightwardly (as viewed in Figures 1 and 2) from the base of the post and defines a cam follower for a cam 72. The tension spring 58 extends from the end of the arm 70 to a pin-like element 74 or screw fastened to the end plate 50. The cam 72 is eccentrically fixed to a shaft 76 by a set screw 77. One end of the shaft 76 is attached to an operating handle 80 (shown in FIG. 1 only). Rotation of the operating handle 80 rotates the cam. The cam includes a high point or lobe 72*a*. When the lobe 72*a* contacts the arm 70, the arm 70 is driven downwardly causing the hinge plate 42 to rotate clockwise about the axis 43, raising the printhead 20 with respect to the platen roller 22. The printhead is normally raised in order to facilitate loading of the print medium through the print mechanism, i.e., to enable the print medium to be threaded between the printhead 20 and the platen roller 22. After the print medium is loaded, the operating handle 80 is reverse rotated enabling the spring 58 to raise the arm 70 thus pivoting the hinge plate 42 counterclockwise and moving the printhead 20 into contact with the print medium 16 located between itself and the platen roller 22. The spring 58 applies a resilient bias so that the printhead is urged into contact by a predetermined force determined by the spring tension. It should be noted here, that as the printhead 20 is lowered, the pivot 38 allows the printhead 20 to rock (about the axis 40) in order to provide a uniform contact force across the print line 24.

Figure 5:
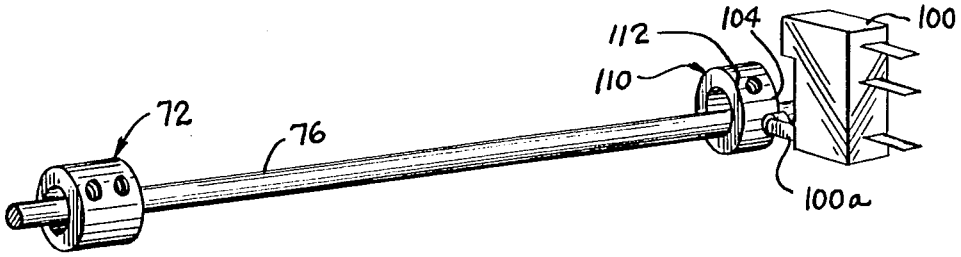
FIG. 5 is a side elevational view of a cam arrangement forming part of the invention; and, FIG. 6 is a side elevational view of a detented guide mechanism forming part of the print apparatus shown in FIG. 1.

In accordance with a feature of the invention, the position of the printhead 20 relative to the platen roller 22 is monitored by a sensor which in the illustrated embodiment comprises a switch 100 (shown in FIGS. 1 and 5). The switch is mounted to the end plate 50 and includes a switch arm 100*a* which may include a roller 104. A cam 110 associated with the switch is rotatable with the printhead separation cam 72 described above. In the illustrated embodiment, both cams 72, 110 are secured to the shaft 76 such that rotation of the operating lever 80 produces concurrent rotation of both cams. The purpose of the switch is to deactivate the printhead 20 when it is not in contact with the print medium. When the printhead 20 is of the thermal variety, it is imperative that it not be energized unless it is in contact with the print medium. When the printhead 20 is not in contact with the print medium, the energy generated by the printing elements in the printhead will not dissipate. This undissipated energy could damage the printhead.

In accordance with this feature, the cams 72, 110 are designed and selected such that the sensor 100 deactivates or disables the printhead 20 prior to any movement in the head 20 away from the platen roller 22. In the illustrated embodiment, this is achieved by advancing the cam 110 so that when the operating lever 80 is rotated, the sensor cam 110 moves the switch arm 100*a* prior to the head separating cam 72 producing movement in the printhead arm 70. Although various methods for achieving this relationship can be used, in the illustrated embodiment the sensor cam is "advanced" with respect to the separation cam, so that its high point (indicated by the reference character 112) immediately actuates the switch 100 when the lever 80 is rotated clockwise. The separation cam 72 does not produce any substantial movement in the printhead 20 until the operating lever 80 is rotated further.

Returning to FIGS. 1 and 2, the print unit 10 can imprint or image a variety of print medium 16 including paper tape and adhesive labels carried on a continuous backing or carrier strip. When adhesive labels are being imprinted, the print mechanism 10 can be operated in two different modes. In one mode, the label and associated carrier are conveyed past the printhead 20 and both travel along a path indicated by the reference character 200, i.e., in a plane substantially tangent to the printline 24. In this so-called "batch" mode, the label remains fixed to the carrier as it is discharged from the print station.

In a second mode of operation, the printhead 20 automatically strips a backing 16' from the label as the label leaves the print station. In the strip mode, the label proceeds along substantially the same path 200 as previously described for the batch mode, while the backing material 16' is partially "wrapped" around the stripper plate 210, the platen roller 22, and the stripper assist bar 220, and wound onto the take up spool 206. Unlike the prior art, however, separate gripper rollers are not needed to strip the backing from the label. According to this embodiment of the invention, the platen roller 22 is used to provide the requisite driving or pulling force for the backing material.

The stripping mechanism includes a stripper plate 210 which is positioned immediately downstream of the print line 24. The stripper plate is parallel and is located in close proximity to the platen roller 22. When the backing is to be stripped from the label, the backing material 16' is fed over the stripper bar and around the lower periphery of the platen roller 22 as indicated by the reference character 202. In order to urge the material 16' into contact with the lower region of the roller, a stripper assist bar 220 is located next to and spaced slightly from the platen roller 22. In the preferred and illustrated embodiment the stripper assist bar parallels the axis 41 of the roller 22. Preferably, the axis of the stripper assist bar is located at a point that is greater than 180° but less than 300° from the print line as measured in the direction of rotation of the platen roller. With this arrangement, the backing material is in frictional contact with at least a 90° portion of the lower periphery of the platen roller 22 and indicated by the angle 'A'. Since the platen roller 22 is normally driven (in order to drive the print medium past the printhead 20, the backing material itself is pulled due to the frictional contact between itself and the lower region of the platen roller.

The stripping operation operates as follows: the label leaving the print station, tends to follow the path indicated by the reference character 200. The carrier on the other hand, diverges sharply from this plan as it is fed downwardly over the stripper bar. To further facilitate separation of the backing material from the label, a relatively sharp but rounded, well defined corner 210a is provided at the left edge of the stripper plate 210. The backing material then re-engages the periphery of the roller 22, the arc of contact (angle 'A') being greater than 90°. This contact provides the necessary pulling force on the backing to cause separation from the label. The carrier is then wound onto the take up reel 206. With the disclosed embodiment, the drive for the take up spool is not relied on to produce the required pulling force on the backing nor is a separate drive roller necessary.

In order to facilitate loading of the print mechanism when used in this mode, the stripper assist bar 220 is supported by a frame that is pivotally mounted for movement between a loading and a retracted position. In the retracted position, the stripper assist bar 220 is spaced from the platen roller 22. The assembly comprises a pair of parallel arms 224 (only one is shown), the upper ends of which, support the stripper assist bar 220. The lower ends are pivotally mounted to the end plate 48 and a supplemental endplate 225 (a portion of which is shown in phantom in FIG. 2). The supplemental endplate is supported by posts **227*a*, 227*b*, 229. The supplemental endplate 225 may be integrally formed with the endplate 50. The frame is rotatable about a pivot axis 230. A locking arrangement including a spring loaded pin 232 is provided to lock the stripper assist bar in its operative position versus the edge 233 of the plate 225**.

The mounting of the stripper assist bar allows it to be dropped to a lower position until the carrier is fed between the platen roller 22 and the stripper bar assembly and onto the take up reel. Once threading has been completed, the stripper bar is rotated counterclockwise and locks into the position shown in FIGS. 1 and 2. The pin 232 is engageable with an edge 233 of a locking plate 234 forming part of the supplemental endplate 225.

Figure 6:
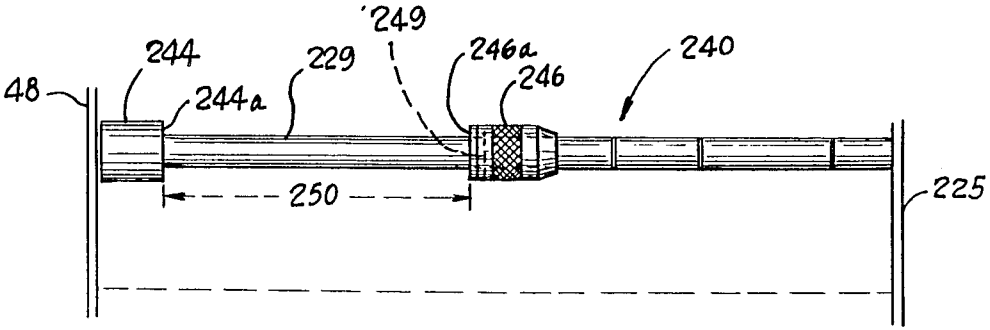

According to another feature of the invention, an easily adjustable guide 240 is provided immediately upstream of the platen roller 22. Referring in particular to FIG. 6, in the preferred embodiment, the guide 240 comprises the post or shaft 229 mounted between the end plates 48, 225. The shaft mounts a fixed collar 244 on one end, a side surface **244*a* of which defines a guide surface for the print medium 16. A movable collar 246 is movable along the shaft 229 and also defines a side surface 246*a*** that defines a guide surface for the other side of the print medium.

In the preferred arrangement a plurality of grooves 248 are formed in the shaft 229 which correspond to commonly used print medium widths. A single detent spring coil 249 forming part of the movable guide 246 is engageable with the grooves 248 so that the guide 246 can be easily positioned to define a guideway 250 for the print medium being loaded or changed. As a result, changing print medium sizes is easily accomplished.

This feature in connection with the printhead raising mechanism allows the operator to change the print medium quickly and without substantial machine down time. Changing the size of the print medium does not require readjustment of either the printhead contact pressure or manual adjustments in the feed path.

As indicated above, the printhead 20 must maintain uniform contact with the print medium 16. The floating relationship provided by the pivotal mounting of the printhead 20 allows the printhead to compensate for misalignment between itself and the platen roller or changes in print medium thickness. The disclosed printing mechanism is capable of high quality printing and is especially useful for printing bar code information. Moreover, the mechanism itself is easily maintained and inexpensive to build. The stripping feature is accomplished with less parts than in many prior art devices and therefore reduces the overall cost of the print apparatus.

Although the invention has been disclosed with a certain degree of particularity, it should be understood that those skilled in the art can make various changes to it without departing from the spirit or scope of the invention as hereinafter claimed.

I claim:

1. A printing apparatus, comprising:

(a) a structure defining a feed path and means for feeding a print medium to be imprinted through said feed path;

(b) a print station including a printhead, a printhead holder for supporting said printhead and a platen located in a confronting relationship with said printhead, said print medium passing between said printhead and said platen when fed through said feed path;

(c) means biasing said printhead and platen towards each other such that a predetermined contact pressure is established between said platen and said printhead when said print medium is fed through said feed path to said print station; and (d) floating mount means supporting said printhead, said floating mount means allowing compensating movement in said printhead relative to said platen whereby a substantially uniform contact pressure is applied to said print medium as it is imprinted by said printhead, said floating mount means comprises first and second pivot members, said first pivot member pivotally supporting said printhead on said printhead holder for pivotal movement about a first axis relative to said printhead holder and to said platen, said second pivot member supporting said printhead holder for pivotal movement about a second axis extending transverse to said first axis of said first pivot member, said printhead holder supporting said printhead and providing for movement of said printhead towards and away from said platen as said printhead holder is pivoted about said second axis.

2. The apparatus of claim 1 further comprising a detented guide means for accommodating various widths of print medium in said feed path located immediately upstream from said print station and a plurality of detents for receiving said detented guide means to position said detented guide means to accommodate various widths of print medium in said feed path.

3. The apparatus of claim 1 further comprising a printhead separating mechanism for effecting movement of said printhead to a position spaced apart from said platen and printhead sensing means operative to sense impending separation movement between said printhead and said platen and operative to disable said printhead to prevent energization when said printhead is moved to said position spaced apart from said platen.

4. The apparatus of claim 3 wherein said sensing means comprises a switch actuatable by a cam that is interconnected to said printhead separating mechanism.

5. A printing apparatus, comprising:

(a) a structure defining a feed path for a print medium and means for feeding said print medium through said feed path, said print medium including a print material carried on a continuous backing;

(b) a print station disposed in said feed path including a printhead and a driven platen roller disposed in a confronting relationship to said printhead, said printhead being operable to imprint on said print medium as it moves through said feed path past said printhead;

(c) stripping means for removing said continuous backing from said printed material, said stripping means including:

(i) a stripper plate disposed downstream and immediately adjacent said platen roller for engaging with said print medium and separating said continuous backing from said print material;

(ii) a stripper assist member for engaging with said continuous backing to cause said continuous backing to be wrapped around a peripheral portion of said driven platen roller such that said continuous backing frictionally engages at least a 90° arc of said peripheral portion of said platen roller, said frictional engagement of said continuous backing with said at least 90° arc of said peripheral portion of said platen roller enabling said driven platen roller to drive said continuous backing through said feed path past said stripper plate;

(iii) a take up means for receiving said continuous backing after it is stripped from said print material.

6. The apparatus of claim 5 wherein said stripper assist member comprises a shaft extending parallel to an axis of rotation of said platen roller.

7. The apparatus of claim 6 wherein said stripper assist member is supported for pivotal movement between an operative position in which said stripper assist member engages said continuous backing to cause said continuous backing to wrap around and frictionally engage with said at least a 90° arc of said peripheral portion of said platen roller and a retracted position in which said stripper assist member is spaced apart from said platen roller.

8. A printing apparatus, comprising:

(a) a structure defining a feed path for a print medium comprising a print material to be imprinted supported on a continuous backing, means for feeding said print medium through said feed path;

(b) a print station disposed in said feed path and including a printhead and a driven platen roller disposed in a confronting relationship to said printhead, said printhead being operable to print on said print material as it moves through said feed path past said printhead;

(c) resilient biasing means urging said printhead towards abutting contact with said platen roller, said resilient biasing means providing a predetermined contact pressure between said printhead and said print medium as said print medium is fed between said printhead and said platen roller;

(d) first pivot means floatingly mounting said printhead with respect to said platen roller and defining a first pivot axis for said printhead extending transverse to an axis of rotation of said platen roller, said first pivot axis allowing said printhead to equalize the contact pressure across the print medium as it is being imprinted by said printhead;

(e) second pivot means mounting said printhead for movement between a first position in which said printhead is disposed in a confronting relationship to said platen roller to effect printing on said print medium and a second position in which said printhead is spaced apart from said platen roller, said second pivot means providing for movement of said printhead towards and away from said platen roller about a second pivot axis extending substantially parallel to the axis of rotation of said platen roller;

(f) a cam assembly for moving said printhead towards and away from said platen roller about said second pivot axis;

(g) printhead disabling means responsive to said cam assembly to sense impending movement of said printhead away from said platen roller about said second pivot axis to said second position and operative upon predetermined movement of said cam assembly to prevent energization of said printhead prior to said printhead moving to said second position;

(h) carrier separating means comprising guide means engaging with said print medium and separating said continuous backing from said print material and directing said continuous backing to follow a diverging path with respect to the path followed by said print material of said print medium, said guide means being operative to cause said continuous backing to frictionally engage at least a 90° arc of the peripheral portion of said platen roller

9. The apparatus of claim 8 further comprising a detented guide means for accommodating various widths of print medium in said feed path disposed upstream from said print station and a plurality of detents for receiving said detented guide means to position said detented guide means to accommodate various widths of print medium in said guide path, said detented guide means including a collar movable to engage with said plurality of detents, said collar defining a side surface for guiding an edge of said print medium.

10. The apparatus of claim 8 wherein said guide means further comprises a stripper assist bar extending parallel to an axis of rotation of said platen roller and disposed in a range of 180°–300° away from a print line defined between said printhead and said platen roller, as measured in the direction of rotation of said platen roller.

11. The apparatus of claim 10 wherein said stripper assist bar is mounted for movement between a retracted position in which said stripper assist bar is spaced apart from said platen roller and an operative position in which said stripper assist bar engages said continuous backing to cause said continuous backing to wrap around and frictionally engage with said at least 90° arc of said peripheral portion of said platen roller.

12. The apparatus of claim 11 wherein said stripper assist bar is disposed substantially 270° from said print line.

13. A printing apparatus, comprising:

(a) a structure defining a feed path and means for feeding a print medium to be imprinted through said feed path, said print medium including a continuous carrier;

(b) a print station including a printhead and a platen roller located in a confronting relationship, said print medium passing between said printhead and said platen roller when fed through said feed path;

(c) means biasing said printhead and platen roller towards each other such that a predetermined contact pressure is established between said platen roller and said printhead when a said print medium is fed through said print station;

(d) floating mount means supporting said printhead, said floating mount means allowing compensating movement of said printhead relative to said platen roller whereby a substantially uniform contact pressure is applied to said print medium as it is imprinted by said printhead; and (e) a stripping mechanism for separating said continuous carrier from the print medium;

(f) said platen roller comprises a driven roller and said stripping mechanism comprises a stripper plate disposed downstream and immediately adjacent said platen roller and a pivotal stripper assist bar disposed adjacent said platen roller, having an axis of rotation substantially parallel to the axis of said platen roller, said stripper assist bar disposed such that said continuous carrier is fed around said stripper assist bar and said stripper assist bar effects contact of said continuous carrier with at least 90° of the periphery of said platen roller.

* * * * *